US005647788A

United States Patent [19]

McHugh et al.

[11] Patent Number: 5,647,788

[45] Date of Patent: Jul. 15, 1997

[54] DRESSING OF GRINDING WHEELS

[75] Inventors: Donald Raymond McHugh, Northville; James Edward Sanders, West Bloomfield, both of Mich.

[73] Assignee: Unicorn Abrasives Limited, Stafford, United Kingdom

[21] Appl. No.: 522,212

[22] Filed: Aug. 31, 1995

[30] Foreign Application Priority Data

Sep. 1, 1994 [GB] United Kingdom ..... 9417603

[51] Int. Cl.[6] ..... B24B 49/00; B24B 51/00

[52] U.S. Cl. ..... 451/21; 451/11; 451/10

[58] Field of Search ..... 451/56, 10, 11, 451/21, 246

[56] References Cited

U.S. PATENT DOCUMENTS

| | | | |
|---|---|---|---|
| 2,054,364 | 9/1936 | De Leeuw | 451/251 |
| 2,195,054 | 3/1940 | Wallace et al. | 451/251 |
| 2,813,378 | 11/1957 | Hill | 451/21 |
| 3,097,454 | 7/1963 | Pheil | 451/251 |
| 4,122,635 | 10/1978 | Asano et al. | 451/21 |
| 4,151,684 | 5/1979 | Wada et al. | 451/21 |
| 4,490,946 | 1/1985 | Tsujiuchi et al. . | |
| 4,539,779 | 9/1985 | Donner . | |
| 4,551,950 | 11/1985 | Unno et al. | 451/21 |
| 4,557,078 | 12/1985 | Brill | 451/21 |
| 4,559,919 | 12/1985 | Kushigian . | |
| 4,570,386 | 2/1986 | Unno et al. . | |
| 4,570,387 | 2/1986 | Unno et al. | 451/21 |
| 4,571,891 | 2/1986 | Donner . | |
| 4,813,188 | 3/1989 | Becker et al. . | |
| 4,897,967 | 2/1990 | Maruyama et al. | 451/21 |
| 4,945,683 | 8/1990 | Phillips | 451/251 |
| 4,991,353 | 2/1991 | Wiener | 451/21 |
| 5,076,020 | 12/1991 | Negri | 451/21 |
| 5,209,020 | 5/1993 | Feisel | 451/21 |
| 5,355,633 | 10/1994 | Ishikawa et al. | 451/10 |
| 5,363,598 | 11/1994 | Imai et al. | 451/21 |
| 5,392,566 | 2/1995 | Wedeniwski | 451/251 |

FOREIGN PATENT DOCUMENTS

| | | | |
|---|---|---|---|
| 2810562 | 9/1979 | Germany | 451/251 |
| 1062818 | 3/1967 | United Kingdom . | |
| 2139533 | 4/1984 | United Kingdom . | |
| 2209696 | 8/1988 | United Kingdom . | |

*Primary Examiner*—James G. Smith
*Assistant Examiner*—Derris H. Banks
*Attorney, Agent, or Firm*—Caesar, Rivise, Bernstein, Cohen & Pokotilow, Ltd.

[57] ABSTRACT

A grinding machine including a bed to receive a workpiece and a plurality of grinding wheels mounted on at least one side of the bed for grinding surfaces of a workpiece received in the bed. The grinding machine includes at least one dressing tool being mounted on a slide arranged for movement towards and away from the grinding surfaces of the grinding wheels, the slide being mounted on a carriage for movement generally parallel to the bed, the slide and the carriage being movable by a prime mover under control of a microprocessor.

7 Claims, 9 Drawing Sheets

DRESSING OF GRINDING WHEELS

The invention relates to grinding machines and in particular to machines for grinding surfaces of workpieces. Such surfaces may be shaped to form lobes, cams, or the like of workpieces such as camshafts, crankshafts or the like.

It is known to grind the required surface by means of a grinding wheel. It is also known to grind several surfaces simultaneously, using a number of grinding wheels mounted in an array and such machines are called multiwheel grinders. It is necessary to make adjustments to each wheel at regular intervals and/or to dress it, i.e. to sharpen its cutting action or to true the wheel, i.e. to keep its shape accurate. For these purposes, it is usual to provide a so-called dressing tool, itself an abrasive wheel, diamond point, or the like. Great care is required to move the dressing tool to the required position and for this purpose use is made of cam followers and like mechanical parts. The dressing can take hours, and despite the care taken by the operators faulty adjustments do occur and workpieces may have to be discarded.

It is one object of this invention to provide improved apparatus for dressing a grinding wheel which can be better controlled by the operator, especially in the case of multiwheel grinding machine.

In one aspect, the invention provides a grinding machine comprising a bed to receive a workpiece; a plurality of grinding wheels mounted on at least one side of the bed for grinding surfaces of a workpiece received in the bed; and dressing means for dressing the grinding wheels; the dressing means comprising at least one dressing tool, the tool being mounted on a slide arranged for movement towards and away from the grinding surfaces of the grinding wheels; the slide being mounted on a carriage arranged for movement generally parallel to the bed, the slide and the carriage being movable by a prime mover under control of microprocessor means.

Because the dressing means is located to one side of the grinding wheels and does not include cam followers, there is a relatively large volume of available space. This enables the dressing tools to be disposed at any appropriate orientation. It also enables a selection of dressing tools, each selected according to the wheels to be dressed.

Preferably the machine includes a platen between the carriage and the slide and means arranged to orient the dressing tool according to the disposition of the surfaces of the grinding tool to be dressed. Preferably the dressing tool is mounted on a spindle pivotally mounted on the slide. Preferably a number of tools is present and these may be the same or different.

In a much preferred feature the dressing tool is mounted so as to grind the grinding surfaces of two neighbouring grinding wheels at the same time.

The carriage to traverse the machine may be arranged for movement using any available technique. Preferably, the carriage includes two generally parallel ball screw assemblies, one of which is arranged to move substantially the length of the carriage and the other of which is arranged to move a shorter distance therealong. In this way, slides on the carriage may be moved relative to each other.

The motive power may be provided using a wide range of sources. Preferably a servomotor is present for each of the carriage and the slide, the motor being under CNC control. Preferably a servomotor is present for each ball screw assembly and a plurality of slides is present, each having a separate servomotor.

The apparatus of the invention is preferably controlled via a microprocessor or programmed logic unit (PLC), most preferably using a computer numeric controlled system (CNC). The CNC may be of any suitable type and incorporates a control panel or keyboard from which the operator can select a wide range of parameters including distance to be travelled by the carriages and slides, the angle of presentation of the dressing tools to the grinding wheels; the specific diameter and shape of wheels; the amount of stock to be removed; and the like. The CNC system will typically control movement of the servomotors. The nature of the CNC control will be selected by the end user according to systems otherwise available to him, his range of requirements and like factors. A wide range of suitable processors can be used, e.g. an Allen Bradley 9/260 CNC control but the invention is not limited to this specific use.

In another aspect the invention provides a method of dressing the grinding surface or a grinding wheel forming part of a grinding machine, especially a multiwheel grinder, the method comprising applying a dressing tool to the grinding surfaces by advancing a slide on which the tool is mounted towards the wheel, and moving as appropriate a carriage on which the slide is mounted, including the step of moving the slide and moving the carriage under CNC control.

Preferably the method includes the step of controlling by the CNC the power supplied to a respective motor associated with the slide and the carriage.

Preferably the method includes the step of adjusting the disposition of the dressing tool by altering the position of a platen present between the carriage and the slide.

Apparatus of the invention allows operators to make adjustments for variations in the process through the CNC for each individual wheel and to control sizes.

Apparatus of the invention includes the programming means necessary to make adjustments for radii by linear and circular interpolation within the control.

Because the dressing tools of the invention do not need to follow a cam of the same diameter they can be used in spaces which are very small and in any orientation, i.e. vertical, horizontal or an angle in between, dependent on the part profile. This makes a device of the invention much more flexible than has been possible hitherto. In addition it becomes possible to maximise the life of the tool, and so saving overall time needed for maintenance and/or replacement of tools.

The apparatus of the invention also provides the capability to dress the post end of crankshaft or other workpiece and other multiple diameters on various parts. This apparatus may utilise either a horizontal or vertical rotary diamond roll depending on the wheel spacing and profile, or use a single point or blade tool. Apparatus of the invention may include a plunge axis on certain applications where it is necessary to combine both dressing for individual wheels, and rotary form dressing where space is not available for dressing. This plunge dresser will be mounted on the same traverse axis as the slide.

A specific example of an advantage of the invention is in the case of grinding the post end of a crankshaft. Because of the restricted space usually available, a traversing rotary diamond tool cannot usually be used. In the present invention because of the extra available space it is possible to include a rotary plunge dressing with the appropriate profile or to include a fixed infeed system for this end of the shaft to be ground.

It is an especial advantage of the apparatus of the invention that the time required to dress a set of wheels on a multi-wheel grinder is reduced. This is especially required in diesel crankshaft grinding. Use of the hydraulic traverse cylinder in the case of known apparatus can only be operated at a speed that gives the proper finish on the wheels. Therefore, this traverse speed is also maintained between the wheels, causing lost cycle time. Apparatus of the invention will minimise time between the wheels, decreasing dressing time and increasing productivity.

Preferably to minimise dressing time the dressing means comprises two infeed slide systems mounted on a common traverse axis, each having a dressing tool. Two independent servo axis will be utilised for each of the infeed and traverse, therefore allowing each system to dress one half of the wheels at the same time. This again will minimise dressing time whilst still providing compensation for each wheel and radii for better part conformance.

The invention is also of value in the side dressing of the wheels for diesel crankshaft in particular. The present procedure is to table mount a single point diamond on an arm which starts by dressing one side of the wheel. This is normally started with the thrust journal of the crankshaft. Once the wheel is 'cleaned-up', the wheels are stopped, measured and then the opposite side of the wheel is dressed to obtain the correct width. This procedure is continued for each wheel while measuring and maintaining the correct wheel spacing. Each time a measurement is required, the wheels must be stopped and this takes a great deal of time. If a wheel location on width is not correct, a complete set of wheels is scrapped out and the process is started again. A normal side dressing procedure can take 2 to 4 shifts depending upon the tolerancing of the wheel spacing. Apparatus of this invention can reduce the time substantially without sacrificing accuracy.

It is a much preferred feature of the invention that a proximity sensor is present to indicate to the CNC control the location of each wheel relative to a nominal position. This information can be processed by the CNC control to determine the amount of stock to be removed from each side of the wheel to optimise the wheel location relative to the workpiece.

Apparatus of the invention may incorporate sensors, e.g. acoustical sensors to minimise side wheel dressing by incorporating a third infeed axis on the slide. This axis may include two single point diamonds which will sense the side of the thrust journal wheel, which will calculate this position from a theoretical 'zero' position. Each wheel is then sensed to determine the amount of stock to be removed for nominal positioning. There is also a determination if the wheel spacing is within a tolerance band necessary for clean-up of the wheels. The control will calculate the amount necessary to dress off each side of the wheel for correct spacing and width. It will be possible to side dress to the full depth if required on a pre-determined amount to clear the counter weights.

The dressing tool will usually be mounted on a spindle at the end of the slide. The spindle may be of any known type, including a hydrostatic powered spindle. It is however a preferred feature of the invention that the spindle be driven directly at a constant speed, even when under load, under control of the CNC control.

In order that the invention may be well understood it will now be described by way of example only with reference to the accompanying diagrammatic drawings, in which.

Figure 1:
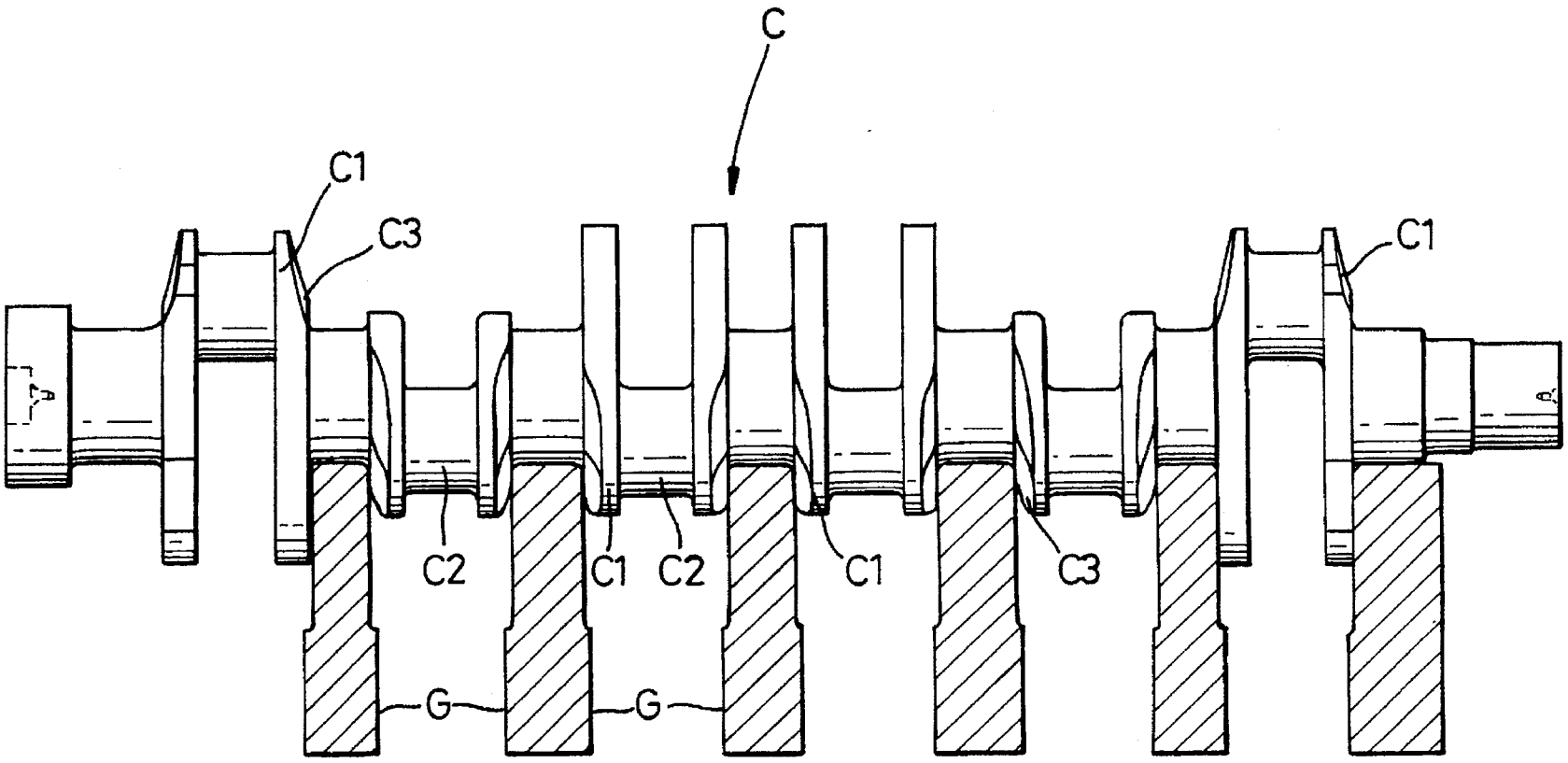
FIG. 1 is a side elevation of a representative crankshaft in the bore of a multiwheel grinding machine, showing the surfaces to be ground and the grinding wheels.

In FIG. 1 there is shown an elongate Diesel crankshaft C having longitudinally spaced apart crank arms or lobes C1 joined together by crankpin journals C2 which are offset from but parallel to the longitudinal axis of the crankshaft C. The side faces C3 of the lobes need to be ground to predetermined shapes and sizes, examples of which are shown. The grinding is done by means of grinding wheels G mounted in generally parallel relation and to the sides of the bed B of the grinding machine. The grinding wheels are mounted on a common drive shaft for rotation or on a slide to reciprocate with respect to the workpiece. As the details of multiwheel grinding machines are known, they will not be set out here.

It is necessary from time to time when grinding a workpiece or when changing the workingpiece to dress the grinding wheels G of a multiwheel grinding machine. For that purpose, according to the invention there is provided a dresser centre or station D.

The dressing station comprises a carriage assembly 1 arranged to travel generally parallel to the longitudinal axis of the grinding machine and above which is a slide assembly 2 which is arranged to reciprocate transversely of the bed B, the slide assembly carrying at its leading end at least one dressing tool 3 on a spindle assembly 49. Parts are shielded by a bellows cover 5.

Figure 4:
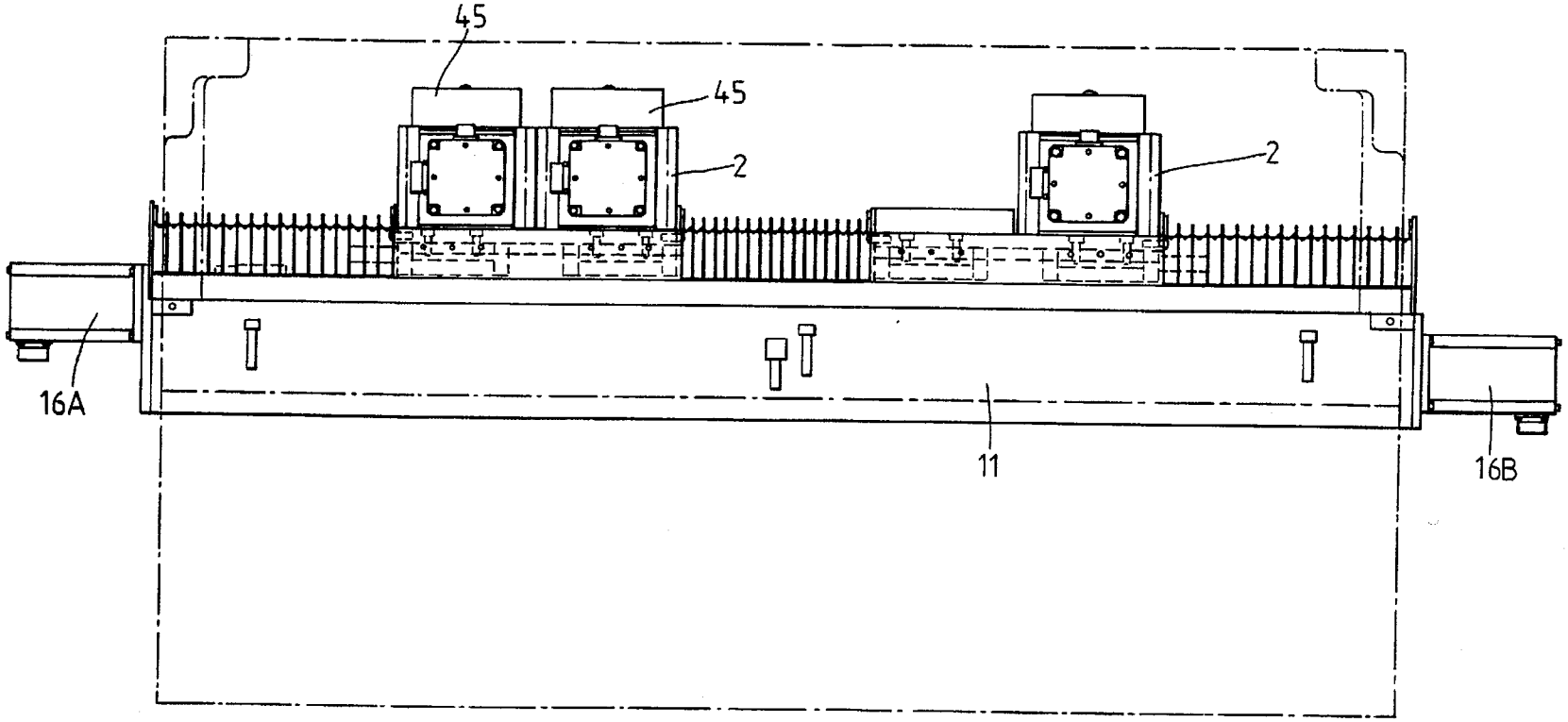
FIG. 4 is a side elevation of the carriage.
Figure 5:
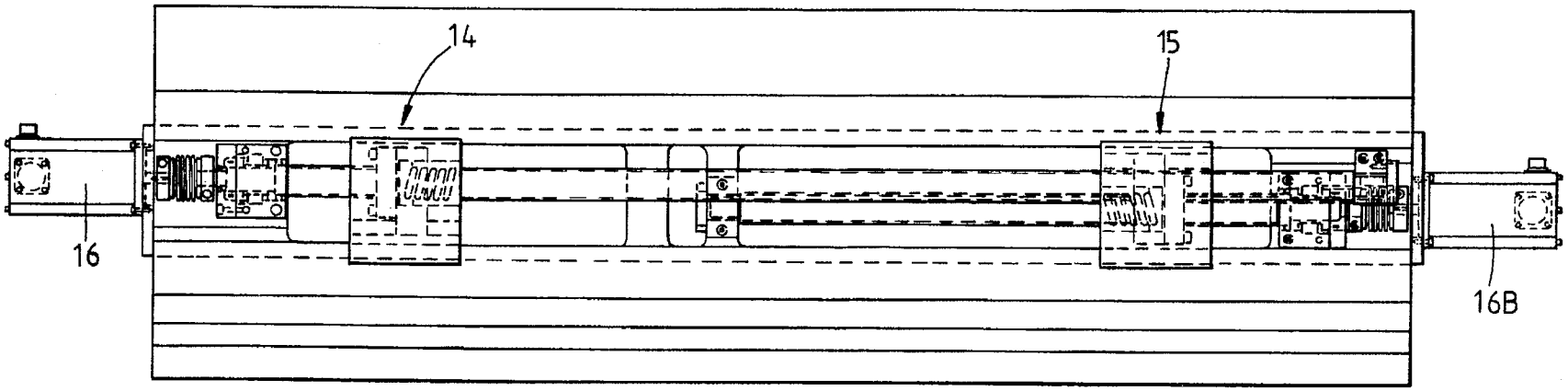
FIG. 5 is a top plan view thereof.
Figure 6:
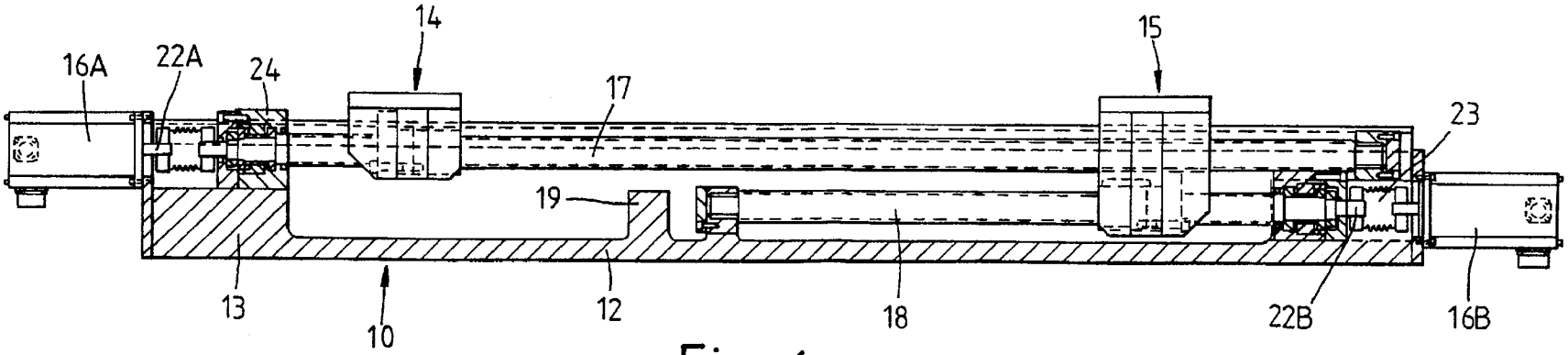
FIG. 6 is a longitudinal sectional view thereof.
Figure 8:
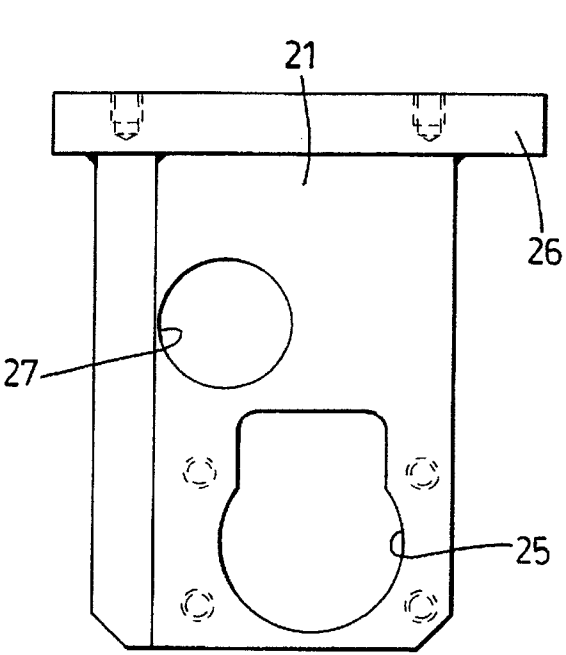
FIG. 8 is the same view of the adapter at the right hand side of FIG. 6.
Figure 7:
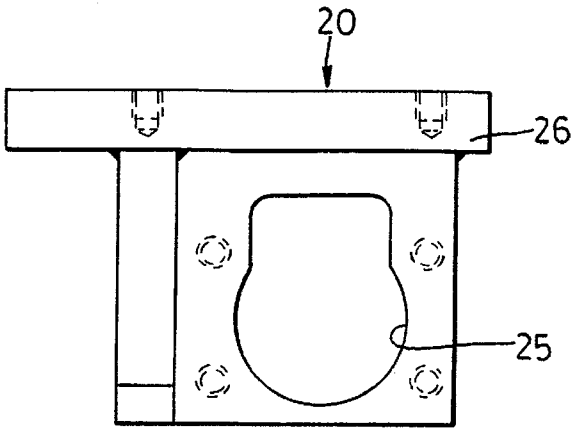
FIG. 7 is an end view of the ball screw adapter shown at the left hand side of FIG. 6
Figure 9:
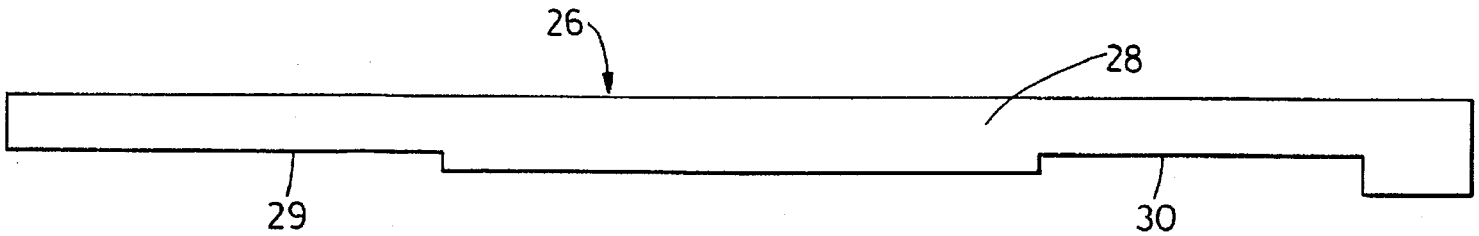
FIG. 9 is an end elevation of the platen above the ball screw assembly.

As shown best in FIGS. 4 to 8, the carriage assembly comprises a base 11 formed as a casting having a floor 12. A well 13 is present at one end. The base supports the ball screw assemblies 14, 15, each moving under power of a separate servomotor 16A, 16B, e.g. a MOOG servomotor. The screw 17 of the assembly 14, the left hand as seen in FIG. 4 extends substantially the length of the base 11 and the other 18 extends from the right hand side to a post 19 adjacent the longitudinal midpoint of the floor 12. An internally threaded nut travels on each bolt 17, 18 and comprises an adapter assembly 20, 21 respectively. The adapter assembly 20 shown in FIG. 7 comprises a nut having a generally keyhole shaped hole 25 through which the screw 17 passes. A platen 26 is screwed or bolted to the top of the nut. The adapter assembly 21 best shown in FIG. 8 is essentially the same shape having a hole 25 and an upper hole 27 to receive the bolt 17 as well. The top of the nut platen 26 is screwed or bolted to the nut 21. The platen 26 is shown in FIG. 9 from which it can be seen to be a plate like body 28 having recesses 29, 30 to receive the top of the nuts of the adapter assemblies 20, 21.

Each motor 16A, 16B, is mounted on a mounting plate at the respective end of the base. The drive shaft 22A, 22B of the motor extends through an adjusting bearing 23 in a housing 24 where it joins the bolt.

Figure 2:
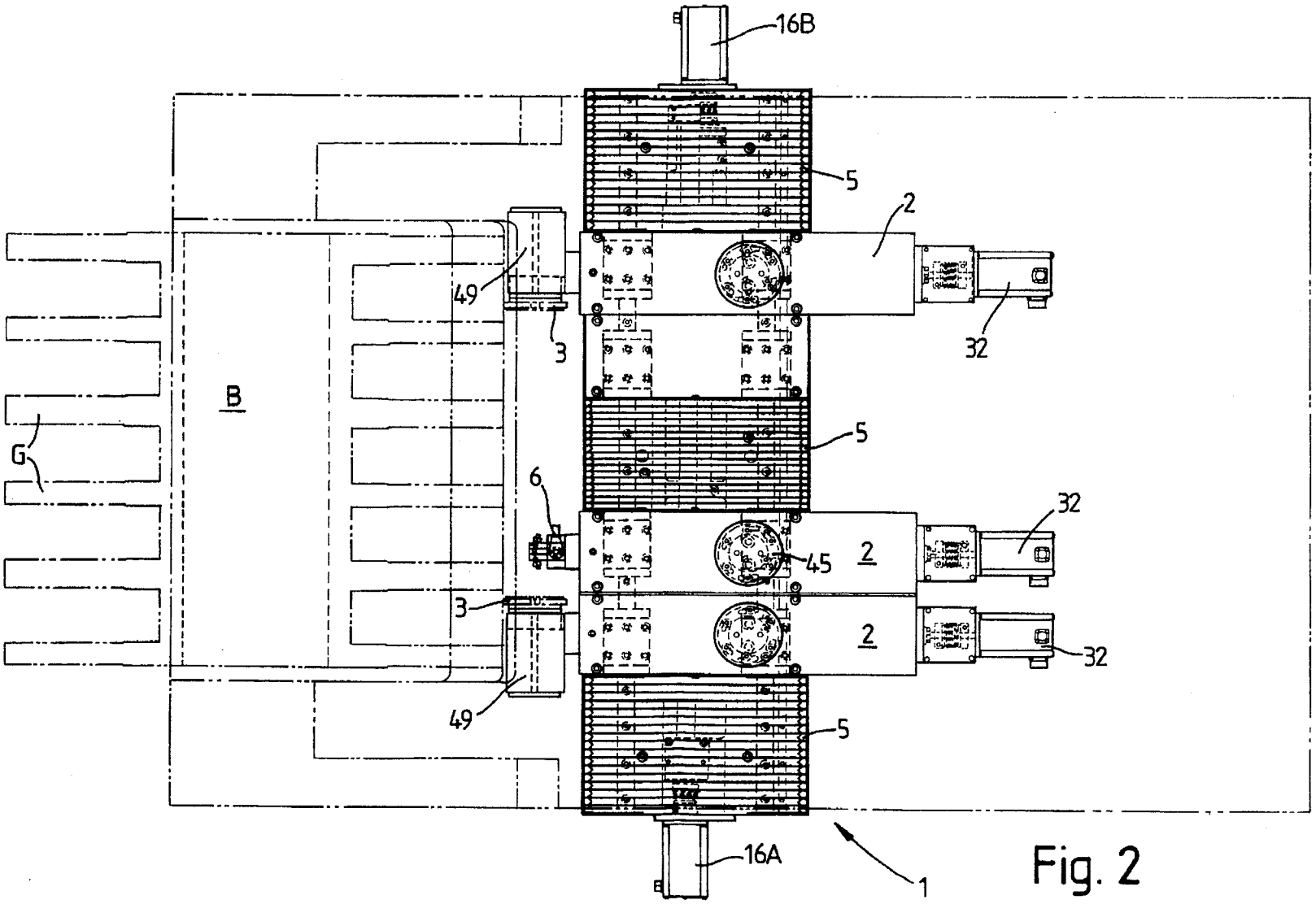
FIG. 2 is a plan view of the machine showing the dressing apparatus of the invention.
Figure 3:
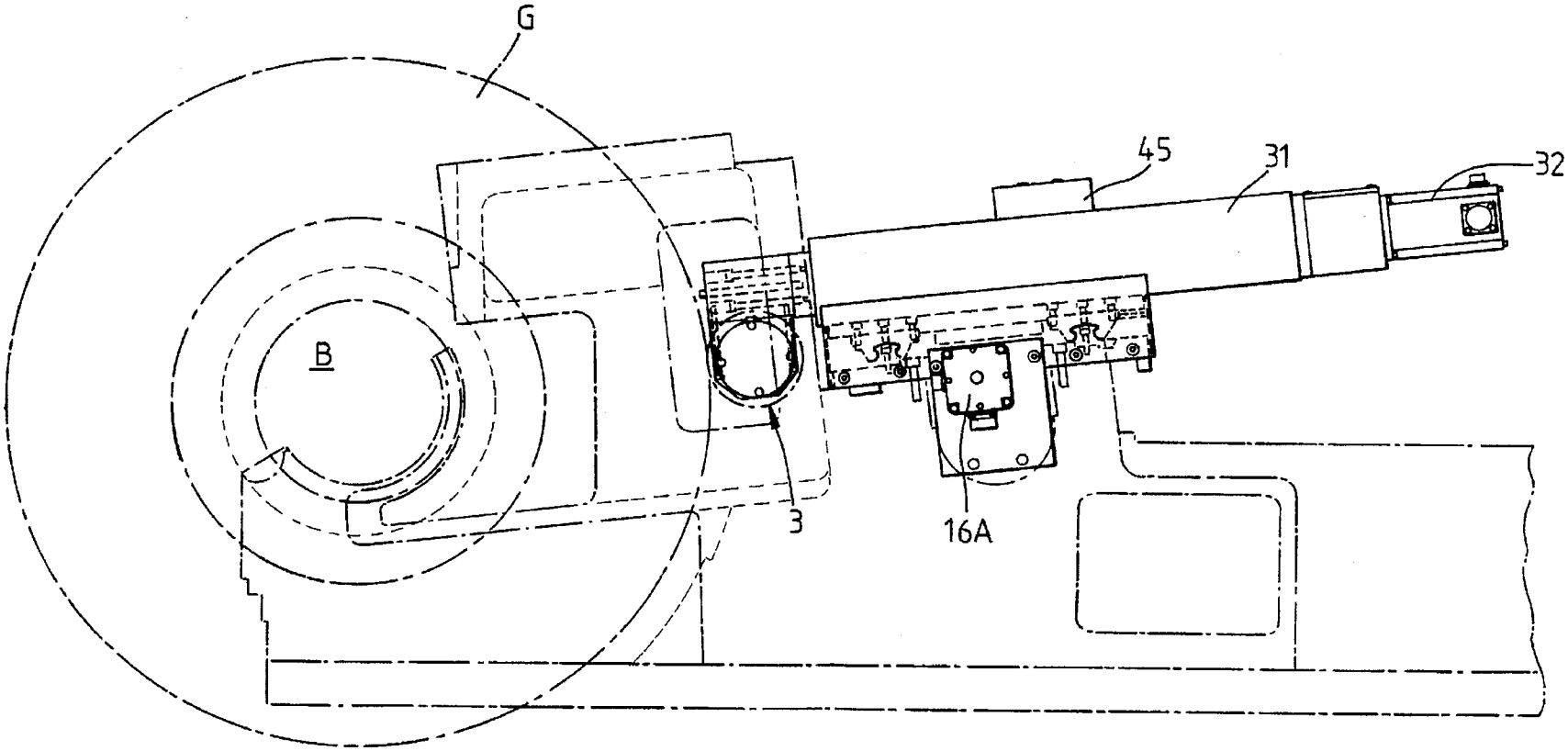
FIG. 3 is an end elevation showing the dressing apparatus.
Figure 10:
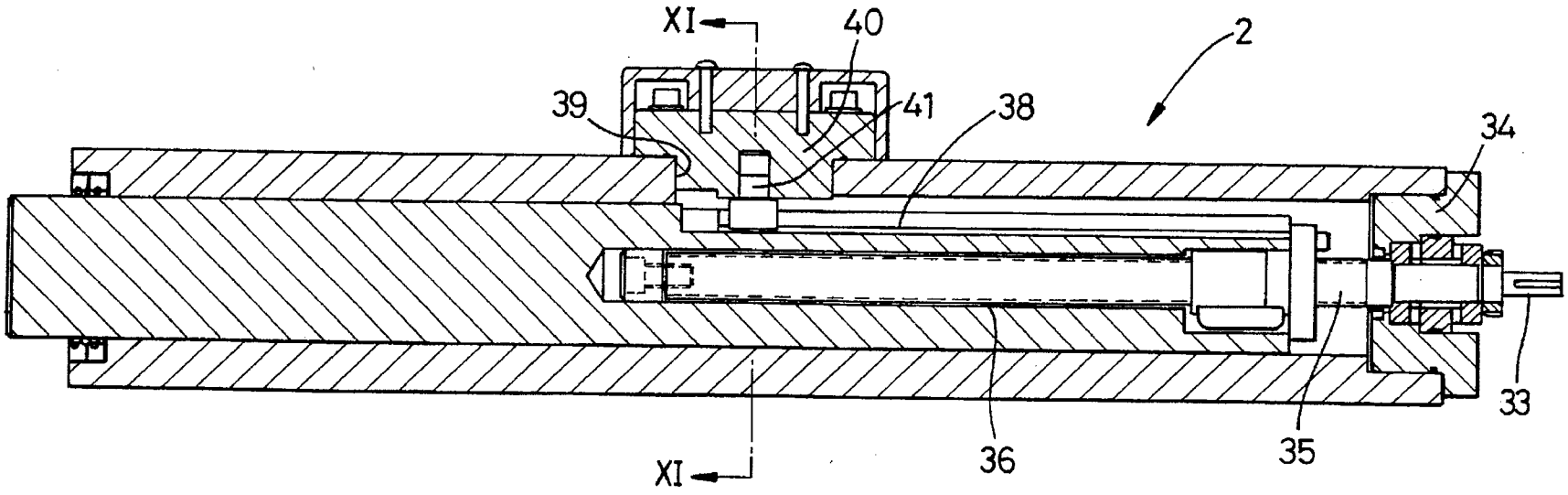
FIG. 10 is a longitudinal section of one slide.
Figure 11:
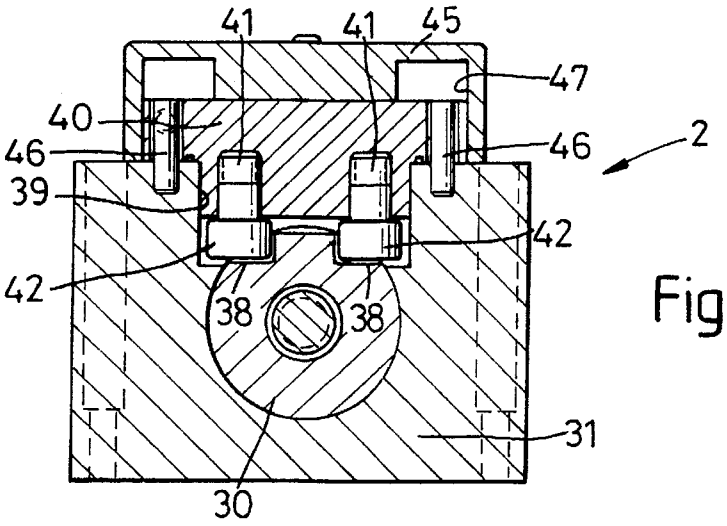
FIG. 11 is a transverse section taken on lines XI—XI on FIG. 10.
Figure 12:
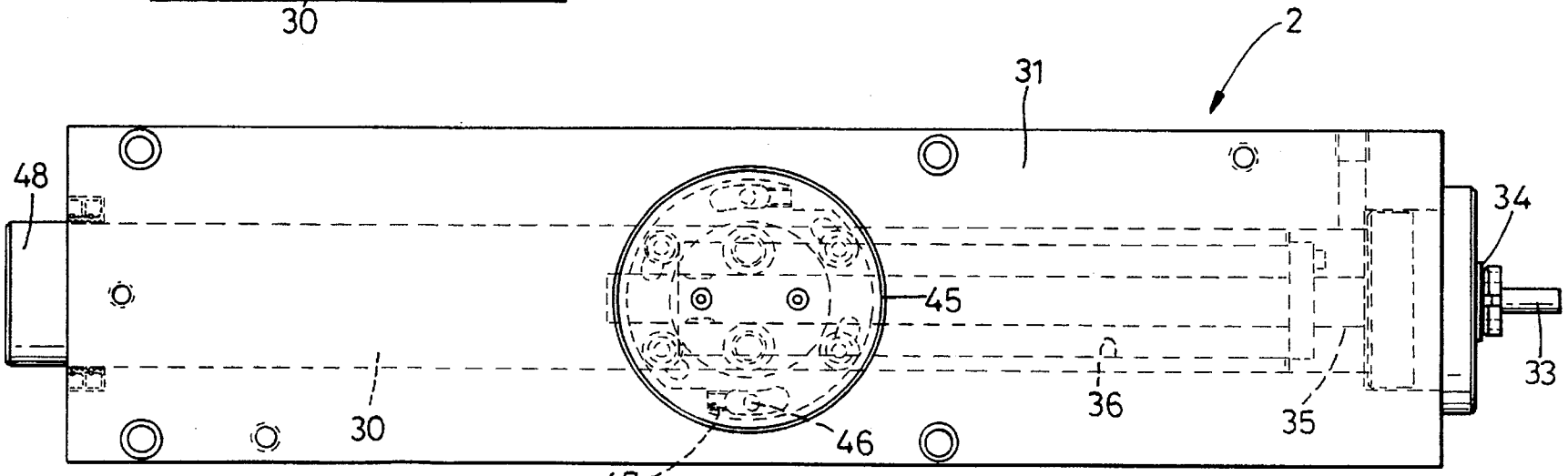
FIG. 12 is a plan view of the slide of FIG. 10.

The slide assemblies 2 are present above the platen 26 and extend across the carriageway assembly 1. The slide assemblies are shown in FIG. 2, a pair being shown in the lower part of the drawing, and a single one in the upper part, and the detailed structure is shown in FIGS. 10 to 12. Each slide assembly 2 comprises a shaft 30 in a barrel 31. The shaft is driven by a servomotor 32, the spindle 33 of which passes through an end cap assembly 34 to contact a spindle 35 within an internal bore 36 in the shaft 30. The top of the shaft 30 at its end near the motor 32 has two elongate flats 38, (best seen in FIG. 11). A hole 39 is present in the roof of the barrel 31 and a block 40 sits in the hole. Two bolts 41 are present in the underside of the block 40, and the heads 42 rest on the flats 36. The block 40 can be rotated using about its centre a top cover 45, pins 46 travelling in enclosed radial slots 47. By adjustment of the block 40 the position of the shaft 30 is adjusted. The effect of the bolts is to prevent rotation of the shaft 30 as the attached spindle is roatated.

The leading end 48 of the shaft 30 may carry a spindle assembly 49, to one side of which is mounted a dressing tool 3. As shown in FIG. 2, dressing tools 3 are present on the outer two spindles 49, and another can be attached to the spindle bracket 6 which can carry a single point cutter.

The motors are each linked via a PLC to a control panel, not shown.

In operation, the operation using the PLC programmed logic controller first moves the traverse slide to bring each dressing tool 3 to the respective grinding wheel G to be dressed. He then adjusts the slide assembly 2 so that the respective dressing tool is at the required angle and then advances that to contact the respective wheel W.

Figure 13:
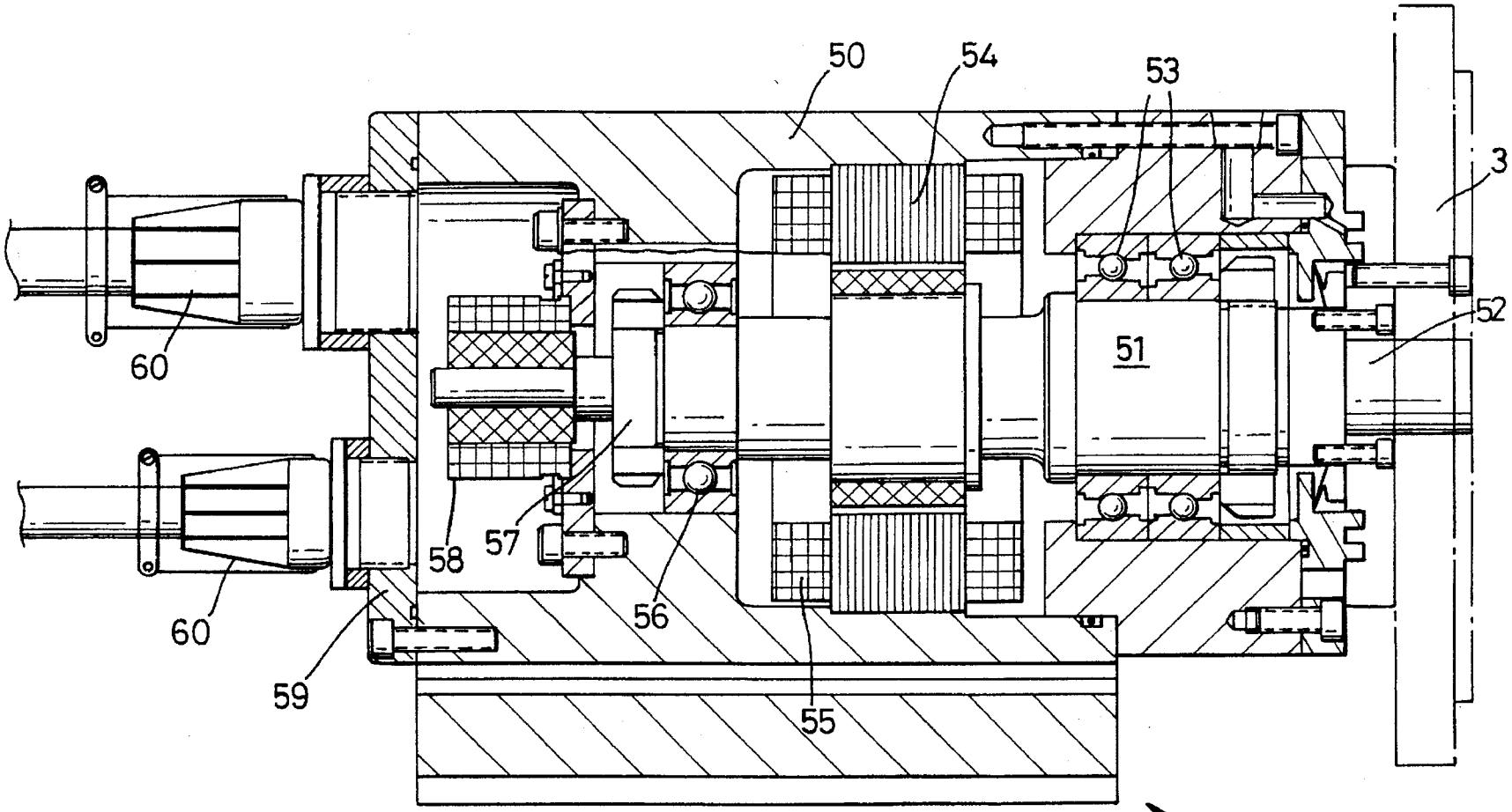
FIG. 13 is a sectional view of a spindle assembly.

The direct spindle assembly 49 is shown in FIG. 13. The assembly comprises a housing 50 containing a spindle shaft 51. At one end, 52, a dressing tool, e.g. a BECK diamond roll 3, is mounted by bolts on the shaft 51. A PROTOMEC acoustic proximising sensor is mounted on the housing immediately behind the roll 3. The spindle shaft 51 is surrounded by BARDEN bearings 53 and a key 54 behind which is a MOOG frameless servo motor 55. A bearing 56 is held in placed by a locknut 57. To the rear is a subassembly 58 of the MOOG resolver, amplifier and appropriate shield and cables. The rear face of the housing is closed by a plate 59 with suitable O rings, spacers and seals. A D.C. supply of electrical power enters the housing via cables 60. In use, the servo provides a positive feed at constant speed even when under load, as sensed via the CNC control.

We claim:

1. A grinding machine comprising an elongate bed to receive a workpiece; a plurality of grinding wheels mounted on one side of the bed for grinding surfaces of a workpiece received in the bed; and dressing means for dressing the grinding wheels; the dressing means comprising at least one dressing tool, the tool being mounted on a slide arranged for movement towards and away from the grinding surfaces of the grinding wheels; the slide being mounted on a carriage for movement generally parallel to the bed, a platen being present between the carriage and the slide; means arranged to orient the dressing tool according to the disposition of the surfaces of the grinding tool to be dressed; the slide and the carriage being movable by a prime mover under control of microprocessor means.

2. A machine according to claim 1, wherein the dressing tool is mounted on a spindle pivotally mounted on the slide.

3. A machine according to claim 1, wherein the carriage includes two generally parallel ball screw assemblies, one of which is arranged to move substantially the length of the carriage and the other of which is arranged to move a shorter distance therealong.

4. A machine according to claim 3, wherein a servomotor is present for each ball assembly of the carriage and for the slide, the motor being under CNC control.

5. A machine according to claim 3 or 4, wherein a plurality of slides is present, each having a separate servomotor.

6. A machine according to claim 1, including an acoustic sensor.

7. A method of dressing the grinding surface of a grinding wheel forming part of a grinding machine, the method comprising applying a dressing tool to the grinding surfaces by advancing a slide on which the tool is mounted towards the wheel, the slide being mounted on a carriage with a platen in between, and moving as appropriate a carriage on which the slide is mounted the slide and the carriage being movable under microprocessor control, including the step of controlling a respective servomotor associated with the slide and the carriage, the method further comprising adjusting the disposition of the dressing tool by altering the position of the platen present between the carriage and the slide.

* * * * *